US005730039A

United States Patent [19]

Holliday et al.

[11] Patent Number: 5,730,039

[45] Date of Patent: Mar. 24, 1998

[54] METHOD AND APPARATUS FOR ADJUSTING THE POSITION OF A CUTTING PLATE

[75] Inventors: B. Kenneth Holliday, Conyers, Ga.; Donald N. Coffey, Chester, Va.

[73] Assignee: South Eastern Die Company, Inc., Decatur, Ga.

[21] Appl. No.: 725,550

[22] Filed: Oct. 3, 1996

Related U.S. Application Data

[63] Continuation of Ser. No. 292,820, Aug. 19, 1994, abandoned.

[51] Int. Cl.[6] ..... B26D 5/00

[52] U.S. Cl. ..... 83/699.41; 83/699.61

[58] Field of Search ..... 29/465, 468; 83/699.31, 83/699.41, 699.51, 699.61

[56] References Cited

U.S. PATENT DOCUMENTS

| | | | |
|---|---|---|---|
| 2,213,919 | 9/1940 | Michon | 83/699.31 X |
| 2,216,208 | 10/1940 | Michon | 83/699.31 X |
| 2,242,363 | 5/1941 | Michon | 83/699.31 X |

FOREIGN PATENT DOCUMENTS

| | | | |
|---|---|---|---|
| 984629 | 3/1965 | United Kingdom | 83/699.41 |

*Primary Examiner*—Joseph M. Gorski

*Attorney, Agent, or Firm*—Fisher Christen & Sabol

[57] ABSTRACT

An apparatus to adjust the position of a cutting plate supported on a bolster plate and to register the cutting plate with a die member in a die cutting press includes alignment plates disposed within openings adjacent opposite ends of the cutting plate, fastening screws to hold the alignment plates in position, and adjustable cams associated with the alignment plates to move the alignment plates and the cutting plate. A method of adjusting the position of a cutting plate is provided and includes the steps of making a first impression with correct paper thickness between a die and the cutting plate, determining the amount of movement of the cutting plate required to provide proper alignment of the cutting plate and die, moving the cams to adjust the position of the cutting plate, making a further impression and determining whether further movement of the cutting plate is necessary, and if no further movement is necessary, tightening the fastening screws to hold the alignment plate and cutting plate in position.

18 Claims, 4 Drawing Sheets

Fig. 6.
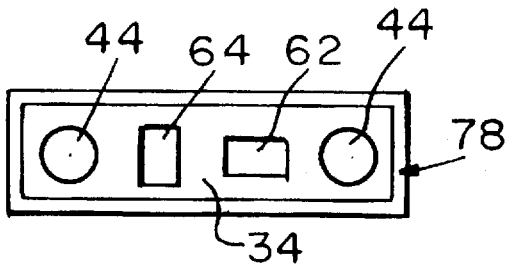
Fig. 7.
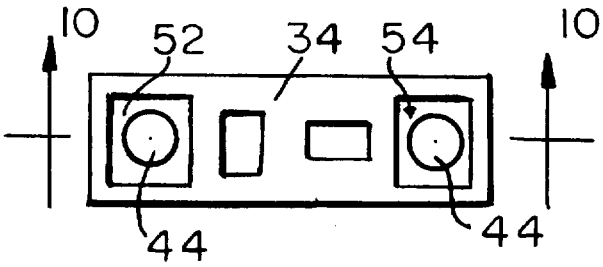
Fig. 8.
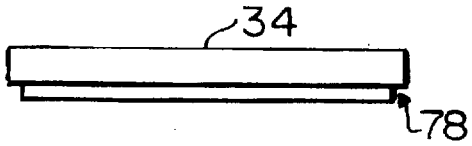
Fig. 9.
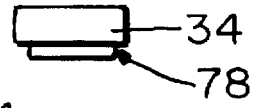
Fig. 10.
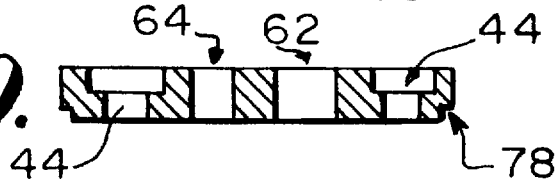
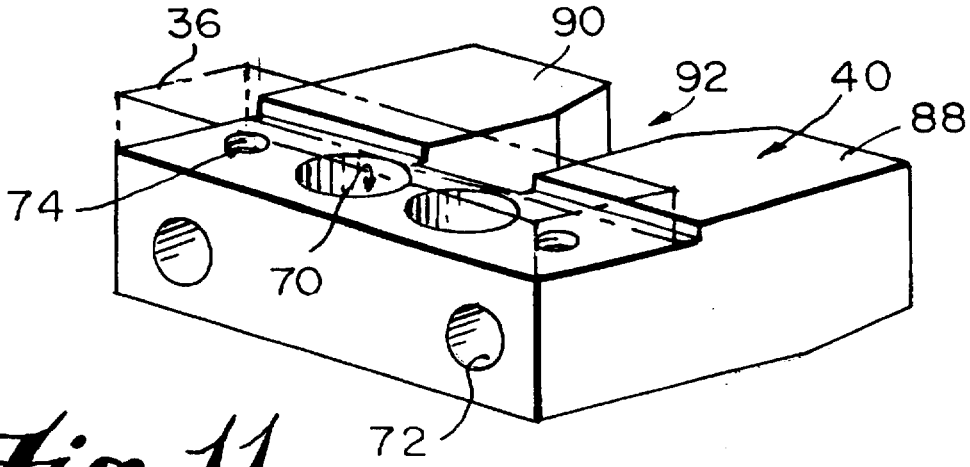
Fig. 11.

METHOD AND APPARATUS FOR ADJUSTING THE POSITION OF A CUTTING PLATE

This is a continuation of application Ser. No. 08/292,820 filed Aug. 19, 1994, now abandoned.

FIELD OF THE INVENTION

The present invention relates to a method and apparatus for adjusting the position of a cutting plate in a die cutting press. More specifically, the present invention relates to an apparatus for adjusting the position of a cutting plate in a die cutting press wherein the apparatus comprises a plurality of alignment plates mounted to a bolster plate and disposed in respective openings in a cutting plate and which have associated cam members to move the alignment plate and cutting plate.

BACKGROUND OF THE INVENTION

In die cutting presses it is essential to register the die member, paper or cardboard to be cut, and the cutting or counter plate. Registration of these members has previously been achieved by adjusting the position of the die member in the die cutting press. Most presses of this type have the die member mounted in an upper position or upper platen of the press. As a result, adjusting the die member is a cumbersome and time consuming project and usually requires four to five hours of labor to release the die member, make adjustments, replace the die member and repeat the process until registration is achieved. A need therefore exists for a method of registering a die member with a cutting plate in a simple fashion to minimize down time of the cutting press. A need also exists for a registration method and apparatus which do not require the removal of the die member or the cutting plate of the press.

Most die cutting presses used for forming paper and cardboard products include a cutting plate which is supported on a bolster plate. The bolster plate in turn is rigidly mounted in the bottom of the die cutting press. Stabilizing or centering blocks are provided on the bolster plate and extend therefrom into corresponding openings of the superposed cutting plate. Such an arrangement rigidly holds the cutting plate in place but provides no adjustment of the cutting plate. As a result, methods of registering the die member and the cutting plate have required adjustment of the die member.

Attempts to adjust the position of the cutting plate relative to the bolster plate have been made by enlarging the openings in the cutting plate and using shims to move the cutting plate relative to the bolster plate. The use of shims in a registration system has failed however because there is no infinite adjustment of the cutting plate, the process of removing and replacing shims to achieve proper registration is extremely time consuming, and no skewing of the cutting plate on the bolster plate is achievable.

A need therefore exists for a method and apparatus of adjusting the position of a cutting plate to provide an infinite adjustment thereof within a range of X and Y coordinates, to provide skewing of the cutting plate, and to provide a quick and easy registration of the cutting plate and die member.

SUMMARY OF THE INVENTION

The present invention is based upon the discovery that the stabilizing blocks described above can be modified to provide an adjustable positioning of the cutting plate relative to the bolster plate. The stabilizing block is milled down to form a mounting block and provided with an alignment plate which is adjustable relative to the mounting block by at least one cam member. In an alternative embodiment which does not include a mounting block, holes to rotatably house cam members are formed directly into a bolster plate and alignment plates are provided resting on the bolster plate and actuated by the cam members.

The present invention also relates to a method of adjusting a cutting plate on a bolster plate which includes the steps of placing an alignment plate in each opening of a cutting plate, aligning the cutting plate to the center of the press, making a first impression with correct paper thickness between a die and the cutting plate, determining the amount of movement of the cutting plate required to provide proper alignment of the cutting plate and die, moving at least one cam member associated with each alignment plate to adjust the position of the cutting plate, and tightening fastening screws to hold the alignment plate and cutting plate in position. If further adjustment of the cutting plate is necessary, the method then also includes the steps of making a further adjustment to the position of the cutting plate and taking a further impression before tightening the fastening means. Only about 30 minutes to one hour are required to align the cutting plate and die member according to the method of the present invention.

The apparatus of the present invention comprises a plurality of alignment plates disposed within openings of a cutting plate, fastening members for holding each alignment plate in position, and adjustable cam members for moving each alignment plate into adjusted position. According to one particular embodiment, two alignment plates are provided, one at each opposite end of a cutting plate, and at least two cam members are provided in at least one of the alignment plates. The alignment plates include elongated slots to accommodate the cam members and may include two elongated slots which are elongated perpendicular to each other to provide directional movement along both an X and a Y axis.

BRIEF DESCRIPTION OF THE DRAWINGS

The present invention may be more fully understood with reference to the accompanying drawings, wherein:

FIG. 6 is a bottom view of the alignment plate of the present invention;

FIG. 7 is a top view of the alignment plate shown in FIG. 6;

FIG. 8 is a side view of the alignment plate shown in FIGS. 6 and 7;

FIG. 9 is an end view of the alignment plate shown in FIGS. 6–8;

FIG. 10 is a cross-sectional view taken along line 10—10 in FIG. 7;

FIG. 11 is a perspective view of a mounting block according to one embodiment of the present invention and showing the position of an alignment plate in phantom lines;

DETAILED DESCRIPTION OF THE INVENTION

Figure 1:
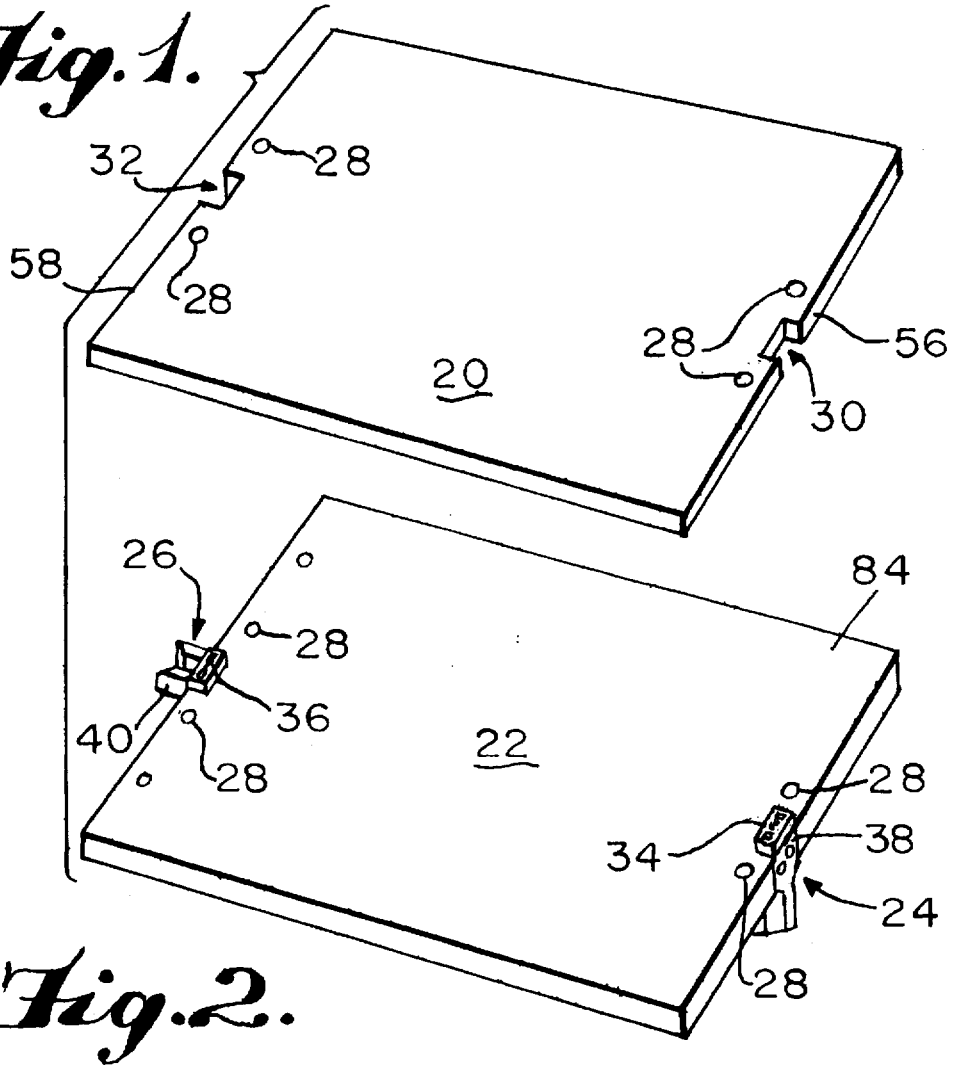
FIG. 1 is an exploded view of a cutting plate and bolster plate of a die cutting press, and two adjustment units according to one embodiment of the present invention.
Figure 2:
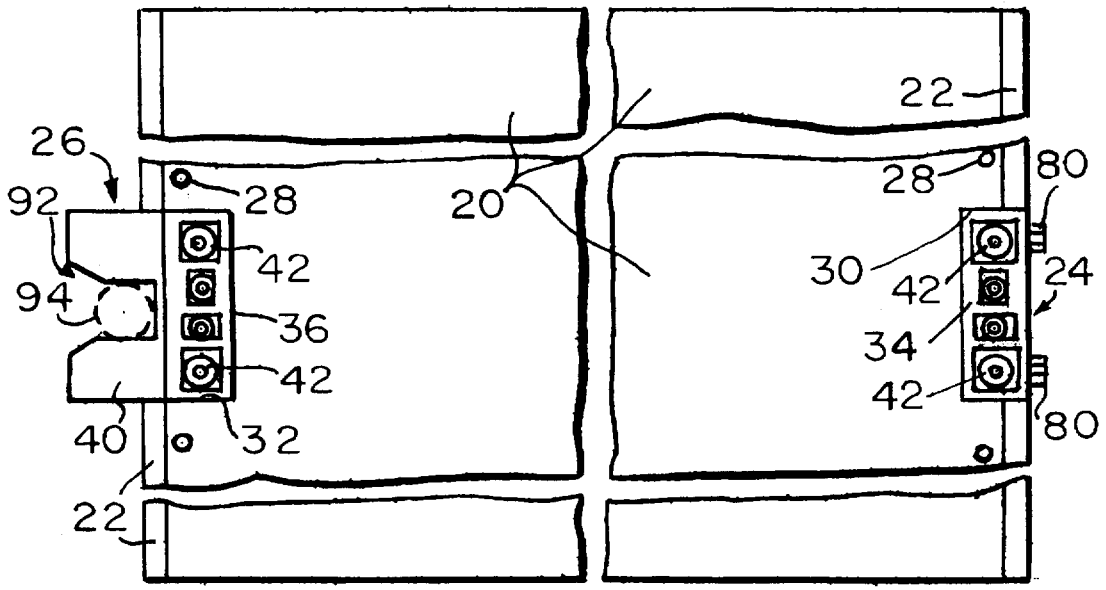
FIG. 2 is a top plan view of the cutting plate and bolster plate of FIG. 1 superposed on each other, and two adjustment units according to an embodiment of the present invention.

FIGS. 1 and 2 show a cutting plate 20 and a bolster plate 22 of one type of die cutting press (not shown). Such a press is available from Bopst S. A,. Lausanne, Switzerland. Typically, the bolster plate is about one inch thick and the cutting plate is about ¼ inch thick. The stabilizing blocks which center the cutting plate 20 on the bolster plate 22 have been modified according to the present invention to include adjustment units 24 and 26. Both the cutting plate 20 and the bolster plate 22 are provided with centering holes 28 for the purpose of receiving a centering member, such as a T-handle dowel tool (not shown) to center the cutting plate on the bolster plate. The cutting plate 20 is provided with openings 30 and 32 adjacent opposite sides thereof. The openings 30 and 32 snugly accommodate alignment plates 34 and 36 of adjustment units 24 and 26, respectively. The alignment plates 34 and 36 extend above the surface of the bolster plate 22 and are mounted on mounting blocks 38 and 40, which are also a part of the adjustment units 24 and 26, for relative movement with respect to the mounting blocks. The bottom portion of the mounting blocks may be tapered to facilitate fitting in an associated recess of the press.

Figure 3:
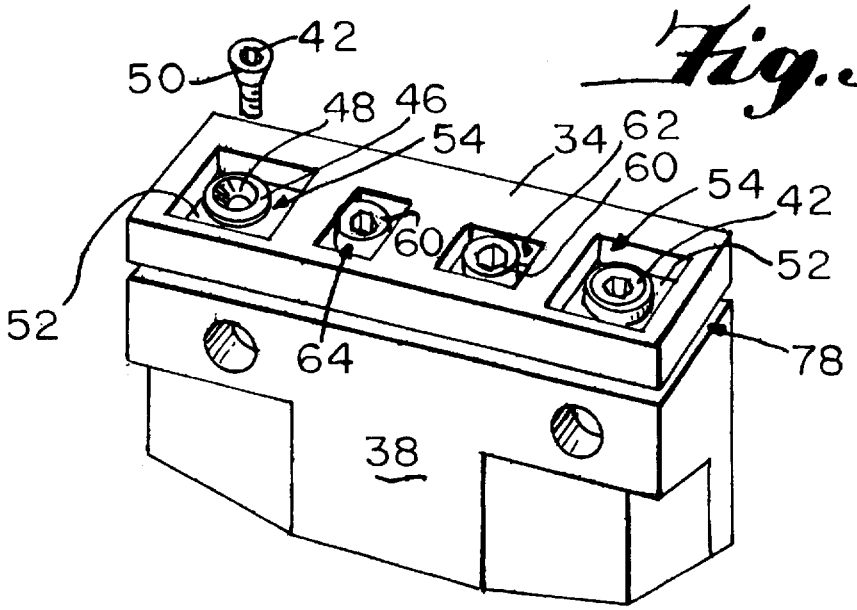
FIG. 3 is a elevational perspective view of an adjustment unit according to one embodiment of the present invention.

Fastening means are provided to rigidly secure the alignment plates 34 and 36 to the mounting blocks 38 and 40, respectively, which are in turn rigidly secured to the bolster plate 22. The fastening means prevent relative movement therebetween. The fastening means are best seen in FIG. 3 and comprise holes 44 formed through the alignment plate and screws 42 extending through the holes. Washers 46 having tapered surfaces 48 may be provided to seat the tapered surface 50 of the screws 42 and to increase the area of contact with the bottom surfaces 52 of recessed portions 54.

As best shown in FIG. 2, the alignment plates 34 and 36 are snugly accommodated in openings 30 and 32, respectively. As best seen in FIG. 1 the openings 30 and 32 comprise notches formed in opposite sides 56 and 58, respectively, of the cutting plate 20. FIGS. 1–5 show the adjustable cams 60 provided for moving each alignment plate into an adjusted position. A portion of each cam 60 extends into or through an elongated slot 62,64 formed in the associated alignment plate. In the embodiment shown in FIGS. 1 and 2, two adjustment units 24 and 26 are provided and each has two elongated slots in the associated alignment plates. Preferably, when two elongated slots are provided in each alignment plate, such as shown in FIGS. 1–4, the two slots are perpendicular to each other.

Figure 4:
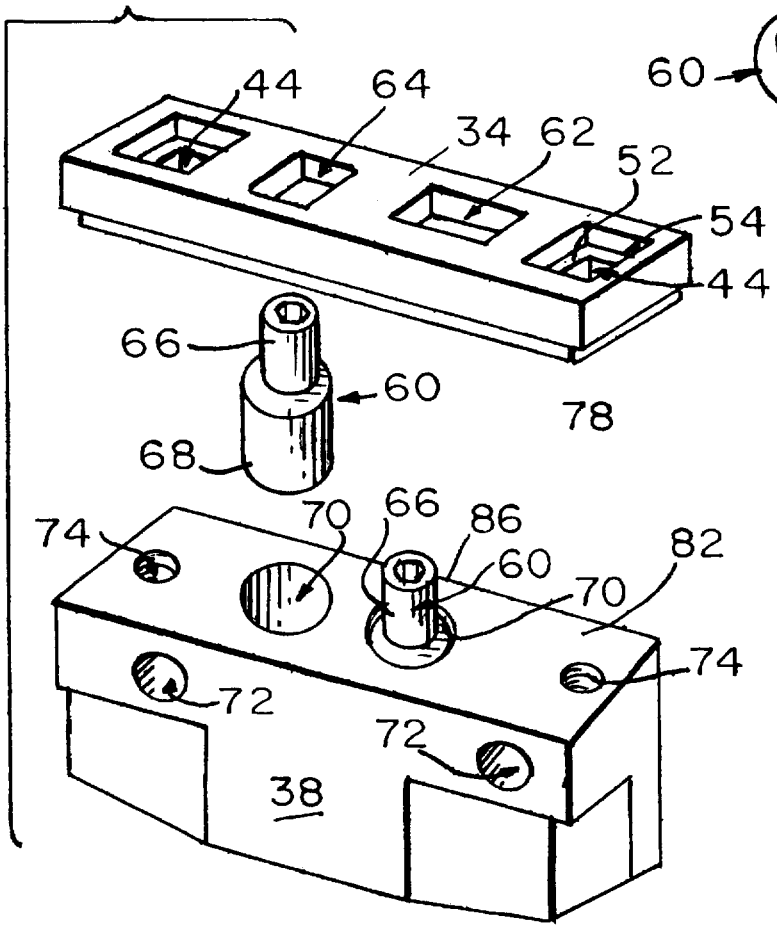
FIG. 4 is an exploded view of the alignment plate, cam means and mounting block shown in FIG. 3.
Figure 5:
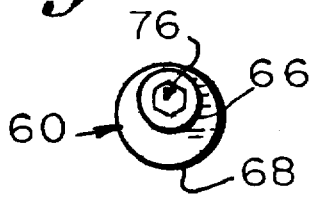
FIG. 5 is a top view of the cam means provided in an adjustment unit according to an embodiment of the present invention.

As best seen in FIGS. 4 and 5, the cams 60 comprise a post portion 66 having a first substantially cylindrical outer surface, and a base portion 68 having a second substantially cylindrical outer surface. The slots 62 and 64 of alignment plate 34 have a width and a length wherein the width of the elongated slots is substantially identical to the diameter of the cylindrical outer surface of the post portion 66 of each cam 60. The post portion 66 of the cam 60 is mounted eccentrically relative to the base portion 68 thereof.

Because of the snug fit of the post portion within the width dimension of the elongated slots, rotation of the cam 60 results in movement of the post portion 66 within the elongated slot which in turn moves the alignment plate in the width direction of the slot but not in the length direction thereof. Thus, in the embodiment shown in FIGS. 3 and 4, rotational movement of one cam results in movement of the alignment plate in an x direction relative to the mounting block 38 and rotational movement of the other cam results in movement of the alignment plate in the y direction. As shown in FIG. 4, the base portion of each cam is rotatably mounted within a hole 70 in the mounting block 38 wherein the hole 70 has a diameter substantially identical to the outer diameter of the base portion 68 of each cam 60. Mounting block 38 is particularly suited for the operator side of a Bobst style press.

The mounting block 38, like mounting block 40, is provided with holes 72 to rigidly secure the mounting block 38 to the bolster plate 22. It should be noted that mounting block 38 is also provided with holes 74 for accommodating the fastening screws 42 which extend through the alignment plate as discussed above. It should also be noted that a hex opening 76 or slot is provided in the post portion 66 of each cam to actuate rotational movement of the cam.

Referring to FIGS. 6–10, details of the alignment plate 34 are more particularly shown. One particular feature of the alignment plate is an undercut 78 which is best seen in FIGS. 8–10. The undercut 78 is provided around the bottom edge of alignment plate 34 and 36 to account for a protruding edge caused by the upper surfaces of the bolster plate and mounting block not being flush. When mounting block 38 (or 40), is secured to the bolster plate 22 by bolts 80 (FIG. 2) extending through the openings 72 and into threaded holes in the bolster plate, the top surface 82 of the mounting block 38, for example, should be flush with the top surface 84 of the bolster plate. However, in the event that the top surface 84 of the bolster plate 22 extends slightly above the level of the top surface 82 of the mounting block 38, the alignment plate would become stuck where the top surfaces 82 and 84 meet. As a result, movement of the alignment plate past the front edge surface 86 of mounting block 38 would be impossible if no undercut 78 were provided. The undercut enables the alignment plate 34 to clear the upper front edge surface of mounting block 38 by at least a few thousandths of an inch, whether or not the top surface 84 of the bolster plate extends slightly above the top surface 82 of the mounting block 38.

Details of mounting block 40 are more clearly shown in FIG. 11. Mounting block 40, like mounting block 38, is provided with holes 72 through which bolts can secure the block 40 to a bolster plate. Mounting block 40 is provided with two leg portions 88 and 90 which are shaped so as to form a tapered recess 92 for accommodating a post 94 of a die cutting press, as shown in phantom lines in FIG. 2. Mounting block 40 is particularly suited for use on the gear side of a Bobst style press. Like mounting block 38, mounting block 40 is provided with holes 70 to accommodate the base portion of cams and holes 74 to accommodate fastening screws. Alignment plate 36 is shown in phantom in an operative position on mounting block 40.

Figure 12:
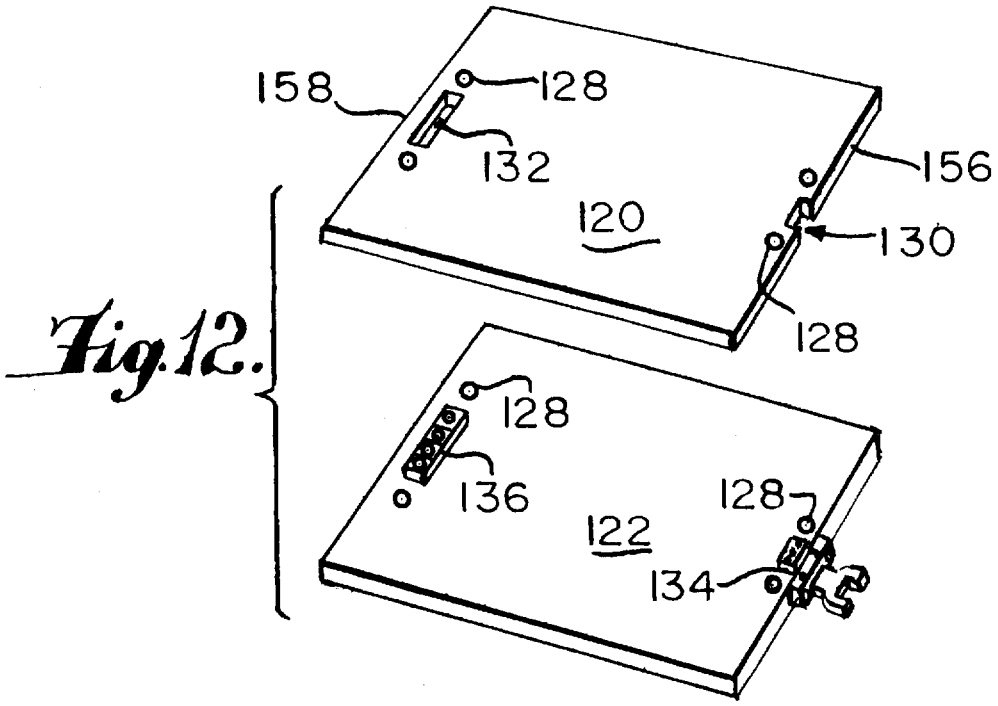
FIG. 12 is an exploded view of a cutting plate, and a bolster plate having alignment plates mounted thereon in accordance with an alternative embodiment of the present invention.
Figure 13:
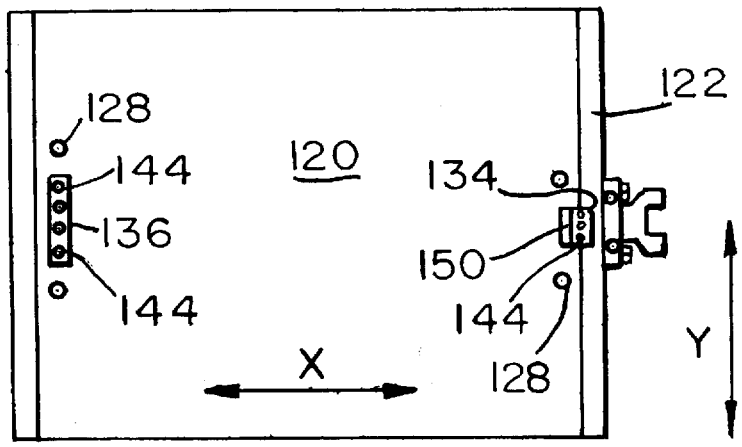
FIG. 13 is a top plan view of the cutting plate and bolster plate shown in FIG. 12, superposed on one another.
Figure 14:
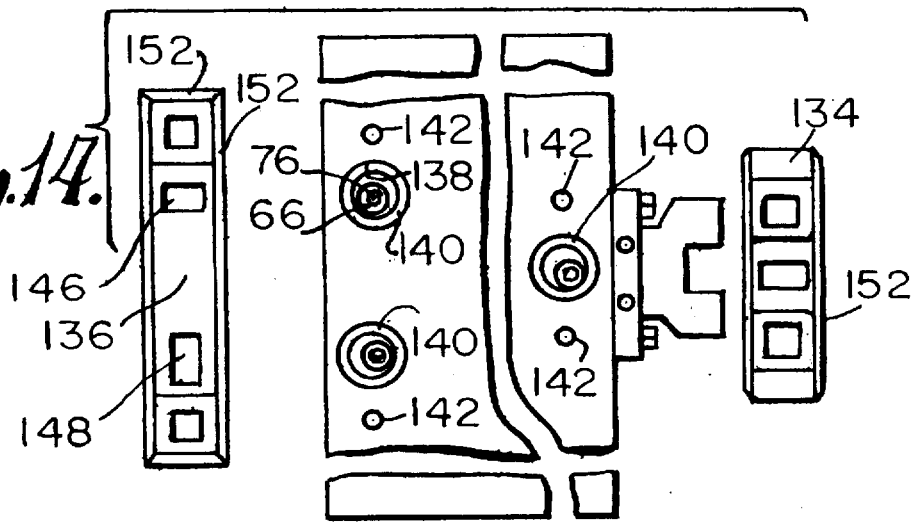
FIG. 14 is a close-up partial top plan and exploded view of the embodiment shown in FIG. 13 detailing the adjustment units used therewith.

FIGS. 12–14 show an alternative application of the present invention for use in a Zerand-type die cutting press.

A cutting plate 120 is modified to provide with openings at opposite ends thereof in the form of a notch 130 at one end 156 of the cutting plate and a hole 132 spaced from the opposite end 158 of the cutting plate. Centering holes 128 are provided through the cutting plate 120 and at least partially into the bolster plate 122 which supports the cutting plate 120. Two alignment plates 134 and 136 are movably mounted on the bolster plate 122 for motion relative to the bolster plate. Instead of mounting blocks for the cam members, the cam members are mounted for rotation in holes 138 formed directly into the bolster plate 122, or mounted for rotation in bushings 140, as shown in FIG. 14. Likewise, threaded holes 142 are formed directly into the bolster plate 122 and receive the fastenings screws 144.

In the embodiment shown in FIGS. 12–14, the alignment plate 136 is captured in the hole 132 of the cutting plate 120, in operation. Thus, unlike the situation where a notch is provided adjacent an end of the cutting plate, all four edges of the alignment plate 136 contact the side walls of the hole 132. As a result, movement of the cutting plate backward and forward in one direction and sideways to sideways in another direction is provided. Preferably, movement is provided in X and Y directions which are perpendicular to each other. As shown in FIG. 14, elongated slots 146 and 148 in the alignment plate 136 are at right angles to each other to provide such an adjustment.

Because both X and Y adjustments are provided by actuation of cams associated with alignment plate 136, the opposite alignment plate 134 need only provide skewing of the cutting plate 120. Skewing is accomplished by movement in a direction substantially perpendicular to a line extending between opposite alignment plates. Therefore, a hole adjacent the end 156 of the cutting plate 120 is not necessary and a notch 130 is sufficient to provide Y directional movement. Alignment plate 134 is adjustable in the Y direction but does not have to move in the X direction. As a result, a gap 150 may be formed between the inside side edge of the alignment plate and the cutting plate when alignment plate 136 is used to move the cutting plate in the X direction away from the alignment plate 134.

When skewing the cutting plate 120, it is important to only slightly tighten the fastening screws 144 for alignment plate 136 so as not to prevent movement of the cutting plate 120 by adjustment of alignment plate 134. To facilitate fitting the openings 130 and 132 over the alignment plates 134 and 136, respectively, the upper edges 152 of the alignment plates are tapered.

Modifications to the above-described adjustment units may be necessary to accommodate members of the particular press on which the present invention is to be applied.

The present invention also provides a method of adjusting the position of a cutting plate supported on a bolster plate in a die cutting press. The method comprises providing a cutting plate having openings adjacent opposite sides thereof. The cutting plate is placed on a bolster plate of a die cutting press. A plurality of alignment plates are provided and each includes fastening means and cam means associated therewith. The method includes the step of placing an alignment plate in each of the openings of the cutting plate and aligning the cutting plate to the center of the press. A first impression is then made with a paper of the correct thickness placed between a die member and the cutting plate. An analysis of the creased or cut paper enables an operator to determine the amount of movement of the cutting plate required to provide alignment of the cutting plate and die. The cam means are moved with a hex wrench or screw driver, depending upon the slot provided to actuate the cam, to adjust the position of the cutting plate. After the position of the cutting plate is adjusted another impression is made and it is determined whether movement of the cutting plate is necessary. If no further movement of the cutting plate is necessary, the fastening means are tightened to hold the alignment plate and cutting plate in the adjusted position. If additional movement of the cutting plate is necessary after a second or subsequent impression, the amount of further movement of the cutting plate required to provide proper alignment of the cutting plate and die is determined. The cam means are then further moved to again adjust the position of the cutting plate. The steps of making a further impression, determining the amount of further movement of the cutting plate required to provide proper alignment, and moving the cam means to adjust the position of the cutting plate, are repeated until proper alignment of the cutting plate and die is obtained. Once proper alignment is obtained, the fastening means are tightened.

Preferably, the method further includes the step of slightly tightening the fastening means before making the first impression. Because the fastening means comprise a fastening screw in a preferred embodiment, slight or moderate degrees of tightening of the fastening means are enabled as opposed to only a two position fastening means, e.g., on and off.

The initial aligning of the cutting plate to center it in the press can be carried out by inserting a T-handle tool through centering holes provided in the cutting plate and the bolster plate. Other devices, or simply a dowel, may alternatively be used to align the centering holes.

Moving the cam means to adjust the position of the cutting plate includes the step of measuring the movement of the alignment plate and cutting plate by a movement indicating means, such as a probe connected to a measuring gauge. A magnetic measuring gauge may be used.

X and Y coordinate movement of the cutting plate can be achieved from a single adjusting unit having two cams and two slots elongated perpendicular to each other. Skewing of the cutting plate may be achieved by moving the alignment plate adjacent the opposite side of the cutting plate in a direction perpendicular to a line intersecting the two opposing adjusting units.

Although the present invention has been described in connection with preferred embodiments, it will be appreciated by those skilled in the art that additions, modifications, substitutions and deletions not specifically described may be made without departing from the spirit and scope of the invention defined in the appended claims.

What is claimed is:

1. A die press, comprising:

a cutting plate having opposite sides, and an opening adjacent each of said opposite sides;

an alignment plate disposed, respectively, within each of said openings, with at least one of said alignment plates having a first slot elongated in a first direction and a second slot elongated in a second direction that is substantially perpendicular to said first direction;

a plurality of supports;

fastening means for movably attaching each of said alignment plates to one of said supports, respectively; and a plurality of adjustable cam means for moving each of said alignment plates relative to said support to which it is attached, with at least one of said plurality of adjustable cam means extending into said first slot and at least another of said plurality of adjustable cam means extending into said second slot, such that movement of one of said alignment plates caused by said cam means causes a corresponding movement of said cutting plate relative to said supports.

2. Apparatus as defined in claim 1 wherein movement of the cam means in said first slot causes movement of the alignment plate in said second direction without moving said alignment plate in said first direction, and movement of the cam means in said second slot causes a movement of the alignment plate in said first direction without moving said alignment plate in said second direction.

3. Apparatus as defined in claim 1 wherein each of said slots has a length and a width, said cam means in said first slot having a substantially cylindrical outer surface having a diameter substantially equal to the width of said first slot, and said cam means in said second slot having a substantially cylindrical outer surface having a diameter substantially equal to the width of said second slot.

4. Apparatus as defined in claim 1 wherein said fastening means includes a hole formed through said alignment plate, and a screw extending through said hole.

5. Apparatus as defined in claim 1 wherein said openings comprise a notch formed in each of said opposite sides of the cutting plate.

6. Apparatus as defined in claim 1 wherein said openings comprise a notch formed in one of said opposite sides, and a hole formed through the cutting plate and spaced from the other one of said opposite sides.

7. A die press, comprising:

a bolster plate;

a cutting plate having opposite sides and an opening adjacent each of said opposite sides;

an alignment plate disposed, respectively within each of said openings, with at least one of said alignment plates having a first slot elongated in a first direction and a second slot elongated in a second direction that is substantially perpendicular to said first direction;

fastening means supported by said bolster plate for movably attaching said alignment plate to said bolster plate; and a plurality of adjustable cam means supported by said bolster plate for moving each of said alignment plates relative to said bolster plate, with at least one of said plurality of adjustable cam means extending into said first slot and at least another of said plurality of adjustable cam means extending into said second slot, such that movement of one of said alignment plates caused by said cam means causes a corresponding movement of said cutting plate relative to said bolster plate.

8. The die press as defined in claim 7 wherein each of said alignment plates has said first and second slots formed therein, and one of said plurality of cam means extends into each of said slots.

9. The die press as defined in claim 8 wherein each of said slots has a length and a width, said cam means in said first slot having a first substantially cylindrical outer surface having a diameter substantially equal to the width of said first slot, and said cam means in said second slot having a substantially cylindrical outer surface having a diameter substantially equal to the width of the second slot.

10. The die press as defined in claim 9 wherein said cam means includes a second substantially cylindrical outer surface supported by said bolster plate, said first-outer surface being disposed eccentrically to said second outer surface.

11. The die press as defined in claim 10 wherein said second outer surface is supported in a mounting block which is connected to said bolster plate.

12. The die press as defined in claim 11 wherein said fastening means includes a hole formed through said alignment plate, and a screw extending through said hole, and wherein said mounting block has a threaded hole for receiving said screw.

13. The die press as defined in claim 10 wherein said bolster plate is provided with a hole in an surface thereof, said second outer surface being disposed within said hole for rotation therein.

14. The die press as defined in claim 13 including a bushing disposed within said hole in the bolster plate and within which said second outer surface rotates.

15. The die press as defined in claim 7 wherein said fastening means includes a hole formed through said alignment plate, and a screw extending through said hole, and wherein said bolster plate includes a threaded hole for receiving said screw.

16. The die press as defined in claim 7 wherein said openings comprise a notch formed in each of said opposite sides of the cutting plate.

17. The die press as defined in claim 7 wherein said openings comprise a notch formed in one of said opposite sides and a hole formed through the cutting plate and spaced from the other one of said opposite sides.

18. The die press as defined in claim 7 wherein movement of the cam means in said first slot causes movement of the alignment plate in said second direction without moving said alignment plate in said first direction, and movement of the cam means in said second slot causes movement of the alignment plate in said first direction without moving said alignment plate in said second direction.

* * * * *